US006398056B1

(12) United States Patent
Letourneau et al.

(10) Patent No.: US 6,398,056 B1
(45) Date of Patent: Jun. 4, 2002

(54) TIPPING-RESISTANT CUP HOLDING TRAY

(75) Inventors: Vincent Letourneau, Waterville; Eric Brown, Benton, both of ME (US)

(73) Assignee: Huhtamaki Company Technology, Inc., Waterville, ME (US)

( * ) Notice: Subject to any disclaimer, the term of this patent is extended or adjusted under 35 U.S.C. 154(b) by 0 days.

(21) Appl. No.: 09/613,261

(22) Filed: Jul. 10, 2000

(51) Int. Cl.[7] ..... B65D 1/36
(52) U.S. Cl. ..... 220/23.8; 206/564; 229/904
(58) Field of Search ..... 220/23.8, 23.83, 220/737; 206/564; 229/2.5, 15, 904

(56) References Cited

U.S. PATENT DOCUMENTS

| | | | | | |
|---|---|---|---|---|---|
| 3,587,915 | A | | 6/1971 | Theobald | 202/415 |
| D236,575 | S | | 9/1975 | Vigue | D7/38 |
| 3,915,371 | A | | 10/1975 | Crabtree | 229/15 |
| D249,620 | S | | 9/1978 | Vigue | D7/38 |
| D249,622 | S | | 9/1978 | Vigue | D7/71 |
| D249,769 | S | | 10/1978 | Vigue | D7/38 |
| D250,243 | S | | 11/1978 | Vigue | D7/38 |
| 4,208,006 | A | * | 6/1980 | Bixler et al. | 206/564 X |
| 4,218,008 | A | | 8/1980 | Vellieux | 229/2.5 R |
| D279,259 | S | | 6/1985 | Bixler et al. | D9/341 |
| D302,122 | S | | 7/1989 | Ashby | D9/425 |
| 5,096,065 | A | | 3/1992 | Vigue | 206/564 |
| 5,316,173 | A | * | 5/1994 | Emery | 229/904 X |
| 5,713,619 | A | | 2/1998 | DuBois et al. | 294/159 |
| 6,076,876 | A | * | 6/2000 | Letourneau et al. | 206/564 X |

OTHER PUBLICATIONS

Photograph, KD–1430 (1977).
Drawing, KD–1430 4 Cup.
Photograph, KD–1503 (1979).
Drawing, KD–1503.
Photograph, KD–1970 (1987).
Drawing, KD–1970.
Photograph, KD–1965 (1988).
Drawing, KD–1965.
Drawing, KD–1991 (Drawing dated 1987).
Photograph, KD 2060 (1989).
Drawing, KD 2060.
Photograph, KD–2194–B (1989).
Drawing, KD–2194–B.
Photograph, KD–2342 (1992).
Drawing, KD–2342.
Photograph, KD–2714 (1997).
Drawing, KD–2714.
Photograph, "Cascades 1993" Tray.
Photograph, "Cascades 1996" Tray.
Photograph, "Cascades Mid–90's 2+2" Tray.
Photograph, "Cascades 1998" Tray.
Photograph, "PCA/Tenn 1983" Tray.
Photograph, "PCA/Tenn 1984" Tray.
Photograph, "4–Plus Jr. PCA/Tenn 1995" Tray.
Photograph, "4–Plus Jr. PCA/Tenn 1996" Tray.
Photograph, "4–Plus Jr. Tenneco 1997" Tray.
Photograph, "Tenneco 1998 4–Plus" Tray.

* cited by examiner

*Primary Examiner*—Steven Pollard
(74) *Attorney, Agent, or Firm*—Connolly Bove Lodge & Hutz LLP

(57) ABSTRACT

A molded tray for holding beverage cups within a range of shapes and sizes is disclosed. The tray has a cup-holding socket proportioned to securely hold inserted cups and prevent them from tipping or falling out of the tray. The cup-holding socket of the tray has stabilizing shoulders and stabilizing walls. The stabilizing walls extend downwardly from the stabilizing shoulders and terminate at a point above the socket floor, creating an opening between the socket floor and the stabilizing wall. The size of the opening is defined as a fraction of the depth of the cup-holding socket.

24 Claims, 2 Drawing Sheets

TIPPING-RESISTANT CUP HOLDING TRAY

FIELD OF THE INVENTION

The invention relates to a cup-holding tray for carrying beverage cups, which contains sockets for holding the beverage cups.

BACKGROUND OF THE INVENTION

The present invention relates to a carry tray for beverage cups or beverage cups and food. The tray is designed to securely hold individual beverage cups of a variety of shapes and sizes. Molded into the tray is at least one cup-holding socket for holding beverage cups. The tray is shaped to permit empty trays to be nested, one within another, to form a convenient and compact stack ("cube") for shipment and storage prior to use.

Molded cup-holding trays are particularly suitable for holding beverage cups that are used in fast-food restaurants. Previous trays for this purpose typically have a number of cup-holding sockets in the tray and may have an additional space provided for holding a bag of food or the like. The cup-holding sockets are intended to securely hold filled beverage cups in an upright position. Certain styles of trays allow for several beverage cups to be carried at once. Examples of existing cup holders of this general type are disclosed in Crabtree, U.S. Pat. No. 3,915,317; Theobald, U.S. Pat. No. 3,587,915; Vellieux, U.S. Pat. No. 4,218,008; and Vigue, U.S. Pat. No. 5,096,065.

A recent trend in the fast-food restaurant industry is the use of very large beverage cup sizes. These cups hold up to, for example, 32 ounces or even 44 ounces of liquid. Therefore, there is a demand for cup-holding tray capable of carrying a these 32–44 oz. cups, as well as the smaller sizes.

Another type of beverage cup that recently became popular has a "stepped" structure where the bottom portion of the cup is smaller in diameter than the top portion of the cup. The lower portion of the cup has a diameter which fits into automobile cup-holders, while the top portion of the cup is substantially larger in diameter to allow the cup to hold more beverage. These "stepped" cups require the use of a cup-holding tray that can securely hold the cups, because these cups tend to be more top-heavy than conventional cups.

Designers of cup-holding trays face several challenges in creating a cup-holding tray capable of carrying large cups, stepped cups, and small cups in a secure and stable manner. These concerns are particularly important when the tray is intended to be used in the fast-food business, where the trays are passed out from carry-out windows or carried through sporting arenas.

For example, the cup-holding tray must be strong enough to carry up to several filled cups at a time without having the tray collapse from the weight of the filled cups. The strength of the cup-holding tray is generally determined from the construction material and the shape of the tray. Typically, trays of this type are made from pulp fiber, and shaped to finished form by molding. For strength reinforcement, trays of this type are molded with a plurality of strengthening ribs, peripheral flanges, and other structural features.

In addition, the cup-holding tray must be able to securely hold the inserted beverage cups, so that they do not tip over or fall out of the cup-holding socket when the tray is loaded and handled. The tray must also securely hold the filled beverage cups as the tray is carried.

In addition to these general concerns, a cup-holding tray should be capable of securely holding filled beverage cups within a wide range of cup sizes. For example, a cup-holding tray specifically sized for the diameter of a 32 oz. cup can be too large to securely hold smaller cup sizes.

One solution to the need for cup holding trays which securely hold both large and small cup sizes is to provide a cup-holding socket with stabilizing walls that extend both downwardly and inwardly into the cup-holding socket. The stabilizing walls are located inward of the walls of the cup-holding socket. DuBois et al., U.S. Pat. No. 5,713,619, disclose a cup-holding socket having three "webs" or stabilizing walls that extend inwardly into the cup-holding socket. These stabilizing walls yield when a cup is inserted into the cup-holding socket. The fit between the stabilizing walls and the cup sides allows for the cup-holding socket to securely hold the cup. However, in the cup holding trays disclosed in DuBois et al., when a small cup is inserted into the cup-holding socket, the stabilizing walls of the cup-holding socket contact the sides of a small cup relatively near the bottom of the cup. Another prior art example of a tray having stabilizing walls in the cup-holding socket is U.S. Pat. No. 4,218,008 to Vellieux.

In the art of cup-holding trays, it is also desirable to minimize the tray's overall size to allow for the trays to be easily passed through typical drive-through window openings. This is particularly challenging in a carrier for four cups. Vigue, U.S. Pat. No. 5,096,065 (Mar. 1992), discloses that to use food trays in drive-thru windows commonly found in fast food restaurants, the overall width of the 4-cup trays should be smaller than about 10.5 to 11.5 inches. Smaller trays weigh less and use less materials to manufacture, which proportionately reduces the overall cost of the trays. Reducing the tray's dimensions also reduces the size and weight of the tray "cube", which allows for more efficient production, shipping and storage of the trays.

SUMMARY OF THE INVENTION

The object of this invention is to provide a cup-holding tray that is capable of more securely and stably holding cups having different shapes and sizes, i.e., from small 8 oz. cups to some styles of large 44 oz. cups, without significantly increasing the overall height, length, and width dimensions of the cup-holding tray as compared to existing trays. Thus, for example, a filled 4-cup tray can be easily passed through fast-food restaurant windows due to the compact size, yet the tray is capable of securely holding cups of different sizes, including very large 44 oz. cup sizes.

Another object of the invention is to provide a compact cup-holding tray that is capable of more securely holding various sizes and configurations of beverage cups.

A further object of the invention is to accomplish these objectives in a 4-cup carrier.

A still further object of the invention is to accomplish these objectives in a 4-cup carrier having four cup-carrying sockets of substantially the same size.

In accordance with the invention, the aforementioned objectives are obtained by providing a cup-holding tray having at least one cup-holding socket for holding a range of beverage cup shapes and sizes. The cup-holding socket has at least two stabilizing shoulders spaced around the cup-holding socket. A preferred embodiment of the cup-holding socket has three stabilizing shoulders. The cup-holding socket has a socket floor, and the stabilizing shoulders of the cup-holding socket are positioned at a distance above the socket floor, substantially at the top level of the tray. Each stabilizing shoulder is provided with an inwardly-sloping stabilizing wall that extends downwardly from the stabilizing shoulder into the socket. The lowermost and innermost points of the stabilizing walls comprise contact points between the stabilizing wall and a cup. A feature of the invention is that the depth of the socket floor is increased relative to the contact points, as compared to prior art trays, such that the cup-holding socket has improved cup-holding ability and is more resistant to tipping than prior designs.

Optionally associated with the socket floor are reinforcing ribs. The reinforcing ribs have a horizontal top surface and a substantially vertical side surface. The top surface is elevated slightly above the socket floor. The bottom of a beverage cup inserted into the socket rests upon a cup-contacting surface. When no reinforcing ribs are present, the cup-contacting surface is the socket floor. When reinforcing ribs are present on the socket floor, an inserted cup sits on the upper horizontal surface of the reinforcing ribs. A cup with a lower rim below the cup bottom can rest on the socket floor if the reinforcing ribs are short.

The stabilizing walls are yieldable so that the stabilizing walls are deflected outwardly by a cup being inserted into the cup-holding socket. Each stabilizing wall extends down into the socket to a distance above the socket floor, so that an opening exists between the bottom edge of the stabilizing wall and the cup-contacting surface. In one embodiment of the invention, a slot vertically bisects the stabilizing wall, so that the opening and the slot together form an inverted "T" shape.

Another object of the invention is that, when the tray is a 4-cup carrier, the tray should not exceed about 9.0 inches in either length or width, since fast food establishments have come to prefer this size. In a preferred embodiment, the top plan view of a 4-cup carrier tray is square and the tray is about 8.75 inches in length and width, and about 2.05 inches in total depth, and the sockets are all substantially the same size.

In accordance with the invention, the cup-holding sockets on a tray of the above dimensions are effectively deepened in relation to the height of the tray. This can be defined as follows: the ratio of the distance from the cup-contacting surface to the contact point on the stabilizing wall to the distance from the cup-contacting surface to the stabilizing shoulder is between 0.4 and 0.5. In a currently most-preferred embodiment, that ratio is about 0.42.

Another feature of the invention is that a circle drawn tangent to the contact points of a cup-holding socket having three stabilizing walls in the cup-holding socket should be greater than 1.9 inches in diameter, preferably about 2.0 inches in diameter. This has been found to improve the cup-holding function of the sockets.

DESCRIPTION OF THE PREFERRED EMBODIMENTS

The invention provides a unitary, molded cup-holding tray, which is molded to substantially finished form from resilient material, such as fibrous pulp. It can be prepared by molding pulp fiber against appropriate molds in a process and manner that is well-known in the art. While molded pulp is preferred, the tray be made from other materials, such as plastic.

Figure 1:
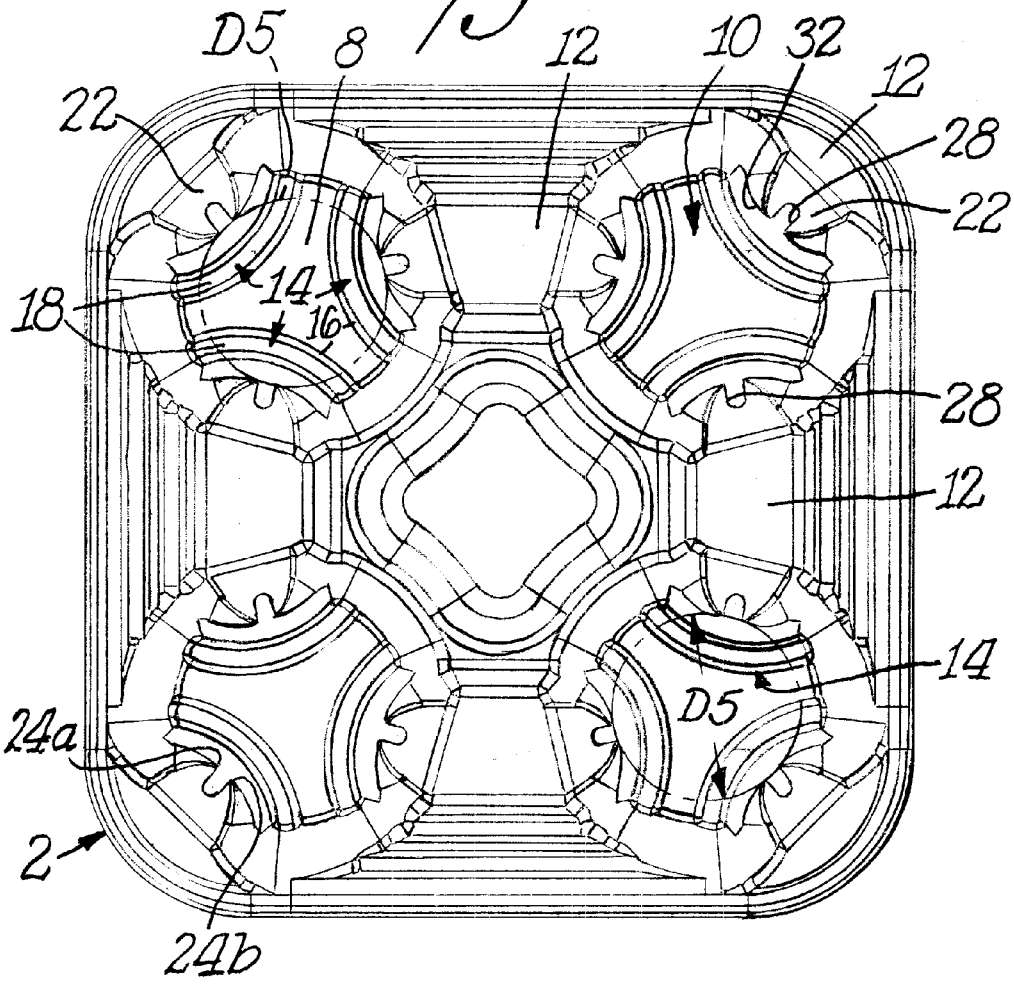
FIG. 1 is a top plan view of one embodiment of the tray of the invention.
Figure 2:
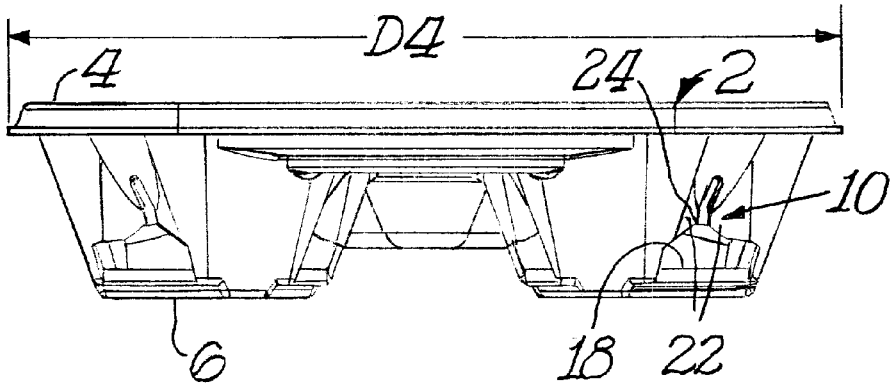
FIG. 2 is a side elevational view of the tray of FIG. 1.
Figure 3:
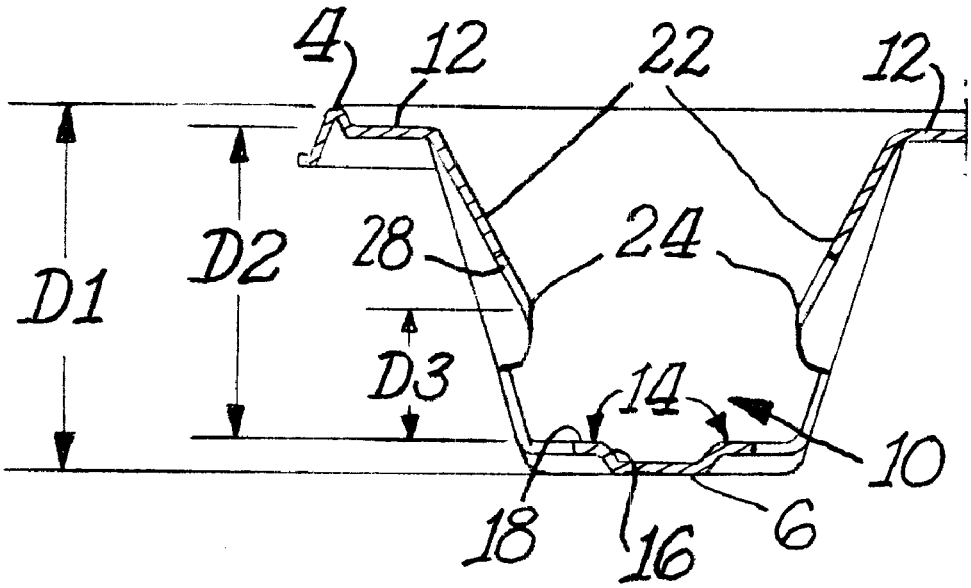
FIG. 3 is a schematic, cross-sectional side view of one cup-holding socket of the tray of FIG. 1 showing the features of the cup-holding socket.

A currently preferred embodiment is shown in FIGS. 1–3 by way of illustration. A cup-holding tray 2 has a top surface 4 and a bottom surface 6. The tray has at least one cup-holding socket 10 molded into the tray to securely hold beverage cups of a variety of shapes and sizes. Such cups include, but are not limited to, those having a flat bottom surface, rim-bottomed surfaces, or stepped shapes.

In the illustrated embodiment shown in FIG. 1, the tray 2 has four cup-holding sockets 10 with one provided in each corner of the tray. However, the tray of the invention can assume any of a variety of configurations and numbers of sockets per tray, including for example those disclosed by Vigue, U.S. Pat. Nos. Des. 236,575, Des. 249,620, Des. 249,622, Des. 249,769, or Des. 250,243. Another embodiment would provide one cup-holding socket which is located in one corner of a rectangular tray with the remainder of the tray having a substantially flat surface to provide a convenient method of carrying food. See, e.g. U.S. Pat. No. 302,122. Another embodiment is to provide a rectangular tray with two cup-holding sockets at one end, with the remainder of the tray comprising a substantially flat food-carrying surface.

Each cup-holding socket 10 comprises at least two stabilizing shoulders 12 positioned around the socket. The stabilizing shoulders are positioned above the socket floor, at a level substantially equal to the top surface of the tray, although they may be slightly lower if the top of the tray includes a raised rim around its periphery, as shown in FIG. 3 at numeral 4. In the illustrated embodiment shown in FIG. 1, there are three stabilizing shoulders 12 spaced substantially equidistantly around each cup-holding socket. In FIG. 1, the inner edges of the three stabilizing shoulders 12 define the size of the socket opening, and thus the diameter of the widest cup size that the cup-holding socket can accommodate. If the cup is "stepped" in diameter, only the narrower, lower portion of the cup needs to fit into the socket.

Each socket is provided with a socket floor 8. The socket floor 8 optionally has reinforcing ribs 14 associated with the socket floor. Each reinforcing rib has a substantially vertical side surface 16 and a substantially horizontal top surface 18. The reinforcing ribs may or may not extend the full length of the opening under the stabilizing wall. The reinforcing ribs are raised slightly above the socket floor, normally to distance of between 1/16–1/4 of an inch. In the illustrated embodiment in FIG. 1, there are three reinforcing ribs 14 associated with the socket floor 8 of the cup-holding socket 10.

The bottom of a cup inserted into the cup-holding socket rests upon a cup-contacting surface. The cup-contacting surface can be either the surface of the socket floor 8, or if reinforcing ribs are present on the socket floor and are contacted by the cup, the horizontal top surfaces 18 of the reinforcing ribs. When the cup-contacting surface is the top surfaces 18 of the reinforcing ribs, then the bottom of the cup inserted into the socket is elevated slightly above the socket floor. If the cup-contacting surface is the socket floor 8, then the bottom of a cup inserted into the socket rests on the socket floor. In the illustrated embodiment shown in FIG. 1, the cup-contacting surface is the top surfaces 18 of the reinforcing ribs.

Extending from each stabilizing shoulder 12 of the cup-holding socket is an inwardly-sloping stabilizing wall 22. Each stabilizing wall 22 extends downwardly from the corresponding stabilizing shoulder 12 to a distance above the socket floor 8. The stabilizing wall 22 may optionally include a slot 28 which vertically bisects the stabilizing wall.

The lowermost, innermost point of the stabilizing wall is defined as the contact point 24 of the stabilizing wall. In the illustrated embodiment shown in FIG. 1, the cup-holding socket 10 has three stabilizing shoulders 12, and each stabilizing shoulder is associated with a stabilizing wall 22 that extends downwardly and inwardly to a contact point 24. In the illustrated embodiment shown in FIG. 1, the stabilizing walls 22 of the cup-holding socket are bisected by a slot which creates two contact points 24 per stabilizing wall (see 24*a* and 24*b* in FIG. 1).

The stabilizing walls 22 yield when a cup is inserted into the cup-holding socket, and are deflected outwardly as the cup is inserted into the socket. The yieldability of the stabilizing walls can be controlled by adjusting thickness, density, and nature of the material, the angle of the stabilizing walls, and the like. The material, such as molded pulp, should have a resilience, such that the deflected stabilizing walls exert a gripping force on the inserted cup, regardless of the cup size.

An important aspect of the invention is the configuration of the socket. This feature can be described by reference to certain distance ratios.

With reference to FIG. 3, the tray has a distance D1 from the top surface of the tray 4 to the bottom surface of the tray 6. Distance D1 is thus the overall height of the tray. Distance D1 should preferably be small, to decrease cube size. At the same time, the tray needs to be deep enough to allow for cup-holding sockets. In a preferred embodiment of the present invention, distance D1 is from about 1.7 to about 2.3 inches, most preferably about 2.05 inches.

Again referring to FIG. 3, the cup-holding socket 10 has a distance D2 from the cup-contacting surface to the height of the stabilizing shoulder 12. As pointed out earlier, the illustrated embodiment has reinforcing ribs, so the cup-contacting surface is the top of the ribs.

If ribs are absent, distance D2 is measured from the socket floor. Distance D2 can be thought of as the "depth" of the cup-holding socket 10. In a preferred embodiment of the invention, distance D2 is greater than about 1.7 inches. In a currently most preferred embodiment, distance D2 is about 1.785 inches.

Referring still to FIG. 3, the cup-holding socket 10 has a distance D3 from the cup contacting surface up to the contact point 24 of the stabilizing wall. In the illustrated embodiment shown in the figures, distance D3 is measured from the contact point 24 of the stabilizing wall to the top surface 18 of the reinforcing rib, which in this embodiment is the cup-contacting surface. Distance D3 should be large enough that the cup-holding socket 10 stably supports both large cups and small cups when they are fully inserted into the cup-holding socket 10. A greater distance D3 means that the contact points 24 of the stabilizing walls contact the sides of the inserted cup higher up on the sides of the cup, which generally increases stability. In a currently most preferred embodiment, the distance D3 is greater than or equal to about 0.75 inches.

As shown in FIG. 2, distance D4 is the overall width of the tray. In the illustrated embodiment, the length and width of the tray are equal and the tray includes four sockets of generally the same size. In a preferred embodiment, distance D4 is from about 8 to about 9 inches, most preferably about 8.75 inches. The tray depth in this embodiment is about 2.05 inches.

Another important aspect of the invention is the diameter of the socket at the level of the contact points. When the tray is viewed from above, a circle can be drawn tangent to the contact points of the stabilizing walls of the cup-holding socket, as shown in FIG. 1. The diameter of this circle is shown at D5 in FIG. 1. The distance D5 is such that the stabilizing walls are deflected to at least some extent by insertion of all the cups in the most common sizes, both large and small. Preferably the distance D5 should be at least 1.9 inches, most preferably about 2.0 inches.

The socket configuration can be alternatively defined, in part, by the ratio of the distance D3 to distance D2. In particular, a ratio of D3 to D2 which is between about 0.4 and 0.5 provides a cup-holding socket that has superior cup-holding properties in the context of a small, compact, and easy to handle tray, particularly a 4-cup carry tray of the above-noted dimensions. This feature of the invention allows the cup-holding socket to have excellent cup-holding properties for holding a wide range of cup shapes and sizes, working within the desired tray dimensions.

To compare the cup-holding ability of the present trays against that of existing cup-holding trays, filled cups were placed in the cup-holding sockets of the trays and the loaded trays were then tilted at four different angles. In these tests, the above-described embodiment of the present invention was used. This tray was then compared against prior art Trays X and Y. Tray X is a product of the Chinet company (having a D2:D3 ratio of 0.377). Tray Y is a product of Tenneco, Inc., known as the "4 Plus Junior", a prior art commercial 4-cup carry tray.

In the tests, two different types of cups were used: (1) 32 oz. plastic cups with stepped sides and (2) 24 oz. plastic cups having a conventional shape. The trays were loaded with filled, lidded cups and then leaned at 25°, 30°, 35°, and 40° relative to horizontal.

The results of these tests are recorded below in TABLES A and B. The cup-holding property of each cup-holder was measured by determining whether the filled cup fell out of the tray at each tilt angle. If a cup fell out of the tray, this was recorded as a failure. The total number of failures was divided by the total number of cups used for each tray and the resulting percentage of failures is shown below in TABLES A and B. If the cup did not fall out of the cup-holding socket, but slightly moved out from the fully-inserted position, this was recorded as a "slight movement". The percentage of slight movements is also shown below in TABLES A

TABLE A

| 32-ounce Plastic Cups | | | | |
|---|---|---|---|---|
| Carrier | 25 Degrees | 30 Degrees | 35 Degrees | 40 Degrees |
| Invention | 0% fail | 0% fail | 40% fail | 60% fail<br>20% slight movement |
| Tray X | 80% fail | 100% fail | — | — |
| Tray Y | 0% fail | 10% fail | 70% fail | 100% fail |

TABLE B

| 24-ounce Plastic Cups | | | | |
|---|---|---|---|---|
| Carrier | 25 Degrees | 30 Degrees | 35 Degrees | 40 Degrees |
| Invention | 0% fail | 0% fail | 0% fail | 0% fail<br>30% slight movement |

TABLE B-continued

| | 24-ounce Plastic Cups | | | |
|---|---|---|---|---|
| Carrier | 25 Degrees | 30 Degrees | 35 Degrees | 40 Degrees |
| Tray X (KD-2342) | >50% fail | 100% fail | — | — |
| Tray Y (4 + Jr.) | 0% fail | 0% fail | 10% fail 40% slight movement | 0% fail 60% slight movement |

From these tests, it is seen that the present invention offers a significant improvement in the ability to hold large filled cups without tipping. Similar improved results have been observed holding 12-oz beverage cans.

The above-described embodiments constitute the best mode now contemplated of carrying out the invention, and are provided as illustration and not as limitation.

We claim:

1. A tray of resilient material having a top surface, a bottom surface, and at least one cup-holding socket to hold cups of different shapes and sizes, the cup-holding socket comprising:

(a) at least two stabilizing shoulders positioned around the socket;

(b) a cup-contacting surface upon which a cup rests when inserted into the socket; and (c) an inwardly-sloped stabilizing wall extending downwardly from each stabilizing shoulder into the cup-holding socket, with the lowermost, innermost area of the stabilizing wall defining a contact point on the stabilizing wall, and wherein each stabilizing wall extends to a distance above the cup-contacting surface providing an opening between the lower edge of the stabilizing wall and the cup-contacting surface, and wherein distance D2 from the cup-contacting surface to the stabilizing shoulder is at least 1.7 inches, and wherein the ratio of distance D3 from the cup-contacting surface to the contact point of the stabilizing wall to distance D2 from the cup-contacting surface to the stabilizing shoulder is between about 0.4 and about 0.5.

2. A tray as claimed in claim 1, wherein, the cup-holding socket has a floor and reinforcing ribs are associated with the socket floor to support the bottom of a cup fully inserted into the socket.

3. A tray as claimed in claim 1, wherein the tray is formed from molded pulp.

4. A tray as claimed in claim 3, further comprising a slot in each stabilizing wall which extends up from the opening between the contact point and the cup-contacting surface and terminates at a point below the stabilizing shoulder.

5. A tray as claimed in claim 4, wherein the opening between the contact point and the cup-contacting surface and the slot in the stabilizing wall together form the shape of an inverted "T" beneath each stabilizing shoulder.

6. A tray as claimed in claim 5, wherein the tray has a generally square shape with a cup-holding socket in each corner, the tray having a length and width of about 9 inches.

7. A tray as claimed in claim 6, wherein distance D2 from the top of the reinforcing rib to the stabilizing shoulder is about 1.785 inches.

8. A tray as claimed in claim 7, wherein the ratio of distance D3 from the top of the reinforcing rib to the contact point of the stabilizing wall to distance D2 from the top of the reinforcing rib to the stabilizing shoulder is about 0.42.

9. A tray as claimed in claim 1, wherein the height of the tray D1 is not greater than 2.3 inches.

10. A molded tray of resilient material having a top surface and a bottom surface, the tray having at least one cup-holding socket for holding cups of different shapes and sizes, the cup-holding socket comprising:

(a) three stabilizing shoulders positioned around the socket, the level of the stabilizing shoulders corresponding substantially to the top surface of the tray;

(b) a socket floor comprising a cup-contacting surface upon which a cup rests when inserted into the socket;

(c) an inwardly-sloping stabilizing wall extending downwardly and inwardly from each stabilizing shoulder into the cup-holding socket, the lowermost, innermost point of the stabilizing wall defining a contact point; and (d) an opening between the stabilizing wall and the socket floor, and wherein the ratio of distance D3 from the cup-contacting surface to the contact point of the stabilizing wall to distance D2 from the cup-contacting surface to the stabilizing shoulder is between about 0.4 and 0.5, and wherein the diameter D5 of a circle drawn tangent to the contact points of the stabilizing walls in the socket is greater than about 1.9 inches.

11. A tray as claimed in claim 10, wherein the tray has four sockets of substantially the same size.

12. A tray as claimed in claim 10, wherein the tray is formed from molded pulp.

13. A tray as claimed in claim 10, wherein a slot in each stabilizing wall extends up from the opening between the contact point of the stabilizing wall and the cup-contacting surface, terminating at a point below the stabilizing shoulder.

14. A tray as claimed in claim 13, wherein the slot in each stabilizing wall extends vertically up the stabilizing wall and forms the shape of an inverted "T" with the opening between the contact point of the stabilizing wall and the cup-contacting surface.

15. A tray as claimed in claim 10, wherein the ratio of distance D3 from the cup-contacting surface to the contact point of the stabilizing wall to distance D2 from the cup-contacting surface to the stabilizing shoulder is about 0.42.

16. A tray as claimed in claim 15, wherein the diameter D5 of a circle drawn tangent to the contact points of the stabilizing walls of the socket is about 2.0 inches.

17. A tray as claimed in claim 16, wherein distance D1 from the top surface to the bottom surface is between about 1.7 inches and 2.3 inches.

18. A tray as claimed in claim 17, wherein distance D1 from the top surface to the bottom surface is about 2.05 inches.

19. A molded tray of resilient material having a top surface, a bottom surface, a length and width, the tray having 4 cup-holding sockets for holding cups of different shapes and sizes, the cup-holding sockets comprising:

(a) three stabilizing shoulders positioned around the socket, the level of the stabilizing shoulders corresponding substantially to the top surface of the tray;

(b) a cup-contacting surface upon which a cup rests when inserted into the socket; and (c) an inwardly-sloping stabilizing wall extending downwardly from each stabilizing shoulder, the lowermost, innermost portion of the stabilizing wall comprising a contact point on the stabilizing wall, and wherein the diameter D5 of a circle tangent to the contact points of the stabilizing walls of the cup-holding socket is equal to, or greater than, 1.9 inches, and the distance D3 from the cup-contacting surface to the contact point of the corresponding stabilizing wall is equal or greater than 0.75 inches, and the length and width of the tray are each between 8 and 9 inches.

20. A tray as claimed in claim 19, wherein the tray is formed from molded pulp.

21. A cup-holding tray of resilient material having length and width dimensions of about 8–9 inches and an overall height of at least 2.0 inches, and four generally equally-sized cup-holding socket to hold beverage cups of different shapes and sizes, the cup-holding socket comprising:

(a) stabilizing shoulders positioned around each socket;

(b) a cup-contacting surface upon which a cup rests when inserted into the socket; and (c) an inwardly-sloped stabilizing wall extending downwardly from each stabilizing shoulder into the cup-holding socket, with the lowermost, innermost area of the stabilizing wall defining a contact point on the stabilizing wall, and wherein the ratio of distance D3 from the cup-contacting surface to the contact point of the stabilizing wall to distance D2 from the cup-contacting surface to the stabilizing shoulder is at least 0.4.

22. The tray of claim 21, wherein the length and width are both about 8.75 inches, the height is about 2.05 inches, and the ratio D3:D2 is about 0.42.

23. A tray as claimed in claim 19, wherein a slot in each stabilizing wall extends vertically up the stabilizing wall, such that the slot forms the shape of an inverted "T" with the opening between the contact point of the stabilizing wall and the cup-contacting surface.

24. A tray as claimed in claim 21, wherein a slot in each stabilizing wall extends vertically up the stabilizing wall, such that the slot forms the shape of an inverted "T" with the opening between the contact point of the stabilizing wall and the cup-contacting surface.

* * * * *